US006688310B1

(12) United States Patent
Toliver

(10) Patent No.: US 6,688,310 B1
(45) Date of Patent: Feb. 10, 2004

(54) VAGINAL MUSCLE EXERCISING DEVICE

(76) Inventor: LaDonna Toliver, 11211 Monan St., Oakland, CA (US) 94605

( * ) Notice: Subject to any disclaimer, the term of this patent is extended or adjusted under 35 U.S.C. 154(b) by 0 days.

(21) Appl. No.: 10/000,568

(22) Filed: Oct. 24, 2001

(51) Int. Cl.[7] ..... A61F 6/02
(52) U.S. Cl. ..... 128/842; 482/148
(58) Field of Search ..... 128/842, 844, 128/918; 604/347–353; 482/121, 148; 600/29–31

(56) References Cited

U.S. PATENT DOCUMENTS 2,591,783 A * 4/1952 Craddock ..... 614/333
4,664,104 A * 5/1987 Jaicks ..... 604/353
5,535,757 A * 7/1996 Fleming ..... 128/842
5,687,741 A * 11/1997 Torger ..... 128/842

* cited by examiner

*Primary Examiner*—Michael A. Brown
(74) *Attorney, Agent, or Firm*—Theodore J. Bielen, Jr.

(57) ABSTRACT

A vaginal muscle exercising device utilizing a garment having a base layer and an overlying second layer of material. An aperture through the second material is capable of supporting a projecting member such that the base of the member lies below the overlying layer and a protuberance extends upwardly. The projecting member is fastened to the garment to remain in such position. The garment is worn by a user and the protuberance is inserted into the vagina of a female subject for exercise.

4 Claims, 2 Drawing Sheets

VAGINAL MUSCLE EXERCISING DEVICE

BACKGROUND OF THE INVENTION

The present invention relates to a novel and useful vaginal muscle exercising device.

It has long been known that vaginal muscles may be strengthened in female subjects by exercising the same. Such exercises have normally included body movements which are based on stretching and movement of adjacent muscles such as those of the legs. Birthing exercises have also been employed through the use of tightening the vaginal muscles during the process of urination to the point that urination is stopped. Such procedures are repeated during each instance of urination during pregnancy to develop muscular control, necessary in the birthing process. Such exercises are referred to as Kegel exercises and are intended to take place during and after pregnancy, the latter intended to increase sexual responsiveness.

A vaginal muscle exercising device which may be employed in conjunction with Kegel exercises would be a notable advance in the medical field.

BRIEF SUMMARY OF THE INVENTION

In accordance with the present invention a novel and useful vaginal or pelvic muscle exercising device is herein provided.

The device of the present invention utilizes a garment which is worn about the pelvis of the user. The pelvic garment also includes a first layer of material and an overlying second layer of material which are generally found in the crotch area of the pelvic garment. The second layer of material is located with respect to the first layer of material to form a pocket having a chamber with at least one aperture to the chamber. In certain cases a second aperture may be included to permit access to the chamber of the pocket.

A projecting member is also employed in the present invention. The projecting member includes a base portion and a protuberance which extends outwardly from the base member. The base portion lies within the pocket chamber formed by the first and second layers of material. The protuberance extends through the pocket aperture and outwardly from the second layer of material. The projecting member lies generally at the crotch area of the garment.

Means is also included in the present invention for fastening the base portion of the projecting member relative to the pelvic garment. Such fastening takes place within the pocket formed by the first and second layers of material. Fastening means of many types may be employed, including snaps, clips, fasteners, glues, and the like. In addition, hook and pile fasteners may be employed to permit removal and fixation of the projecting member within the pocket formed by the first and second layers. Moreover, the projecting member may be positioned within the pocket of the pelvic garment through one aperture and the protuberance may extend through a second aperture, that may be in the form of a slit facing toward the body of the user of the pelvic garment. The protuberance may be constructed as a rounded member and be formed of flexible or elastomeric material.

It may be apparent that a novel and useful vaginal muscle exercising device has been hereinabove provided.

It is therefore an object of the present invention to provide a vaginal muscle exercising device which is easily worn in conjunction with a pelvic garment. Another object of the present invention is to provide a vaginal muscle exercising device which includes a projecting member that is inserted into the vagina of the user when in use and may be held in place by a pelvic garment.

Another object of the present invention is to provide a vaginal muscle exercising device which is easily manufactured and maintained.

A further object of the present invention is to provide a vaginal muscle exercising device which includes a projecting member that is removable and easily cleaned or replaced with a like projecting member in conjunction with a pelvic garment.

A further object of the present invention is to provide a vaginal muscle exercising device which utilizes a removable projecting member in conjunction with a pelvic garment that is securely fastened during times of use.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS OF THE INVENTION

Various aspects of the present invention will evolve from the following detailed description of the preferred embodiments thereof which should be taken together with the hereinabove delineated drawings.

Figure 3:
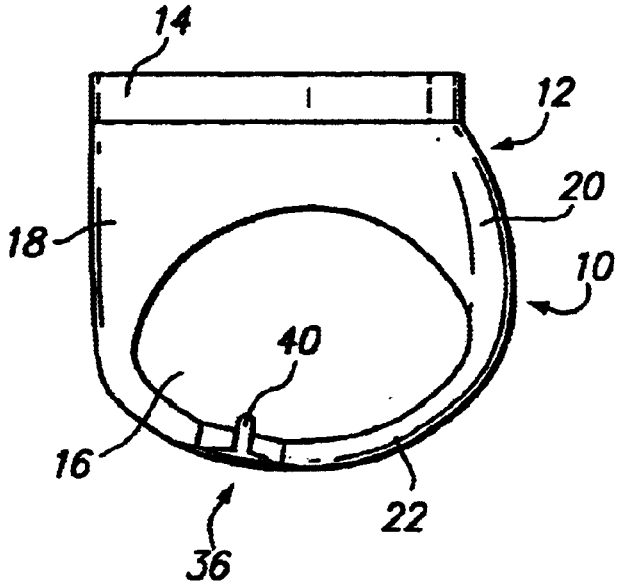
FIG. 3 is a side elevational view of the device of the present invention showing a broken away portion in the vicinity of the projecting member.

The invention as a whole is shown in the drawings by references character 10. As shown in FIG. 3, device 10 includes as one of its elements a pelvic garment 12 having an elastic waist band 14 which is intended to fit around the waist of the user, and leg opening 16 which extends to both sides of garment 12. Front portion 18 and rear portion 20 complete the garment which is generally in the form of a bottom brief type of underwear. Garment 12 further includes a crotch portion 22 which extends between the legs of the user during use.

Figure 1:
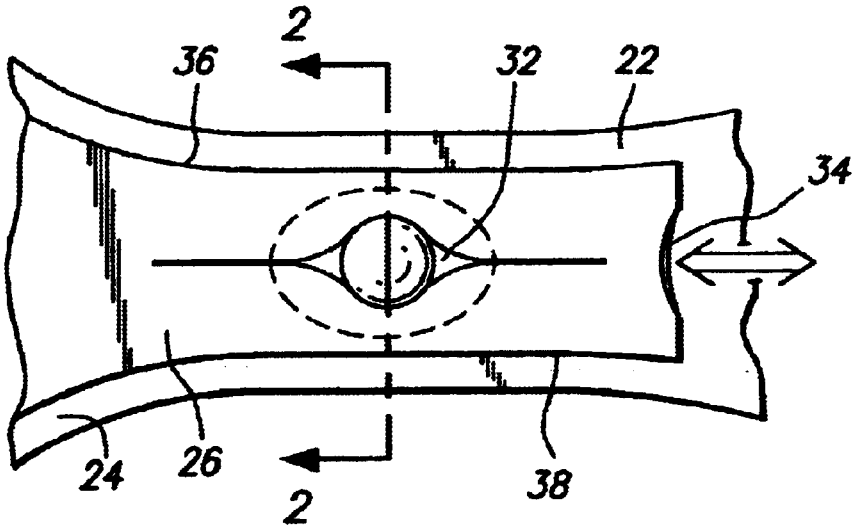
FIG. 1 is a top plan view of the crotch portion of a garment forming a portion of the present invention.

Turning to FIG. 1, it may be observed that crotch portion 22 is depicted in portion and in greater detail. Crotch portion 22 includes a first layer of material 24 and an overlying layer of material 26. Both layers of material 24 and 26 may be formed of any suitable flexible, and preferably absorbent and breathable material such as cotton, nylon, wool, and the like.

Figure 2:
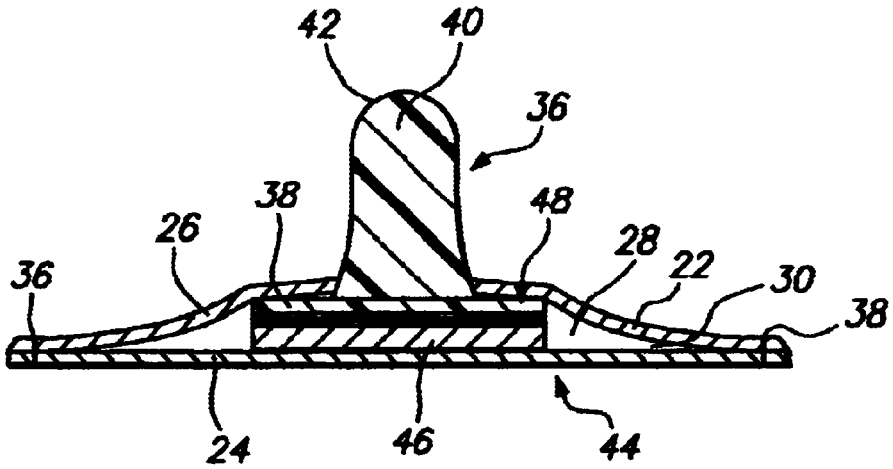
FIG. 2 is a sectional view taken along line 2–2 of FIG. 1.

Turning to FIG. 2, it should be seen that second layer 26 overlies first layer 24 to form a pocket 28 having a chamber 30. Sew lines 36 and 38 hold the second layer 26 in overlying configuration relative to first layer 24.

Device 10 also includes a projecting member 36. Projecting member 36 is formed with a base portion 38 and a connected protuberance 40. Projecting member 36 may be formed of any soft and flexible material such as silicon, rubber, polymeric plastics, and the like. Protuberance 40 includes a rounded end 42. Projecting member lies, as depicted in FIG. 2, such that base member 38 is positioned within chamber 30 while protuberance 40 extends outwardly therefrom a certain distance.

Means 44 is also included in device 10 for fastening base portion 38, relative to garment 12, specifically to first layer 24. Means 44 is depicted in the drawing as including a strip of material 46, and hook and pile fastening means 48 between layer 46 and base portion 38. Of course, other fastening means may be employed such as clips, glue, springs, and the like. As depicted in FIG. 2, projecting member 36 is removable from chamber 30 of pocket 28 either through aperture 34 or aperture 32, in the form of a slit.

Figure 4:
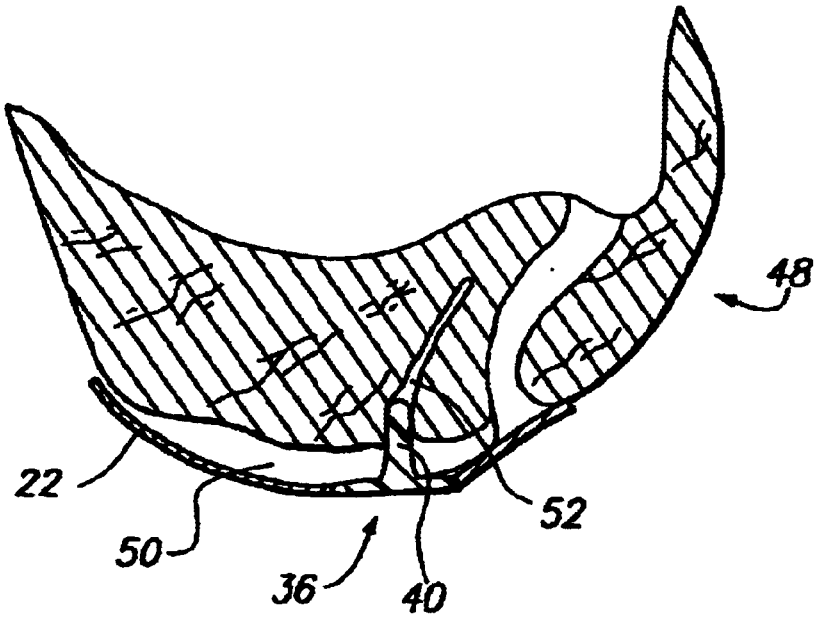
FIG. 4 is a sectional view showing insertion of the projecting member in the vagina of a user with a portion of the garment associated therewith depicted in section.

In operation, the user places pelvic garment 12 on the user's body such that waistband 14 surrounds the waist of the user and leg openings 16 surround the legs of the user. Crotch portion 22 immediately extends adjacent the genitalia of a female user of device 10. With respect to FIG. 4, it should be apparent that a pelvic region 48 is sectioned to show the labia 50 and the vagina 52 of a female user. Crotch portion 22 of pelvic garment 12 is depicted in section showing projecting member 36 in place therewithin. Protuberance 40 is inserted into vagina 52 and may now be used with the Kegel exercises heretofore described. That is to say, the vaginal muscles surrounding vagina 52 are tightened and loosened periodically to strengthen the same in conjunction with projecting member 36. After use, projecting member 36 may be removed from crotch portion 22 of pelvic garment 12 and cleaned or replaced for further use.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A vaginal muscle exercising device, comprising:

a. a pelvic garment including a first layer of material and an overlying second layer of material, said second layer of material forming a pocket, said pocket including a chamber, a first aperture to said chamber, and a second aperture to said chamber, said second aperture being sized to pass said projecting member into and out of said pocket;

b. a projecting member, said projecting member including a base portion and a protuberance positioned outwardly from said base portion said base portion lying within said pocket chamber and said protuberance extending through said pocket second aperture and outwardly from said second layer of material; and c. means for fastening said base portion of said projecting member relative to said pelvic garment and within said pocket.

2. The device of claim 1 in which aid means for fastening said base portion of said projecting member relative to said garment comprises hook and pile fastener means associated with said garment and said projecting member.

3. The device of claim 1 in which said second aperture comprises a slit.

4. The device of claim 1 in which said protuberance comprises a rounded member formed of flexible material.

* * * * *